US010309399B2

(12) United States Patent
Inoue

(10) Patent No.: US 10,309,399 B2
(45) Date of Patent: Jun. 4, 2019

(54) ROTARY COMPRESSOR

(71) Applicant: FUJITSU GENERAL LIMITED, Kanagawa (JP)

(72) Inventor: Akira Inoue, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 278 days.

(21) Appl. No.: 15/481,032

(22) Filed: Apr. 6, 2017

(65) Prior Publication Data

US 2017/0298936 A1 Oct. 19, 2017

(30) Foreign Application Priority Data

Apr. 13, 2016 (JP) ..... 2016-080229

(51) Int. Cl.

| | |
|---|---|
| ***F04C 18/332*** | (2006.01) |
| ***F04C 18/356*** | (2006.01) |
| ***F04C 23/00*** | (2006.01) |
| ***F04C 23/02*** | (2006.01) |

(52) U.S. Cl.

CPC ..... *F04C 18/3564* (2013.01); *F04C 18/332* (2013.01); *F04C 23/001* (2013.01); *F04C 23/008* (2013.01); *F04C 23/02* (2013.01)

(58) Field of Classification Search

CPC ..... F04C 18/332; F04C 18/3564

See application file for complete search history.

(56) References Cited

U.S. PATENT DOCUMENTS

2012/0260691 A1 10/2012 Hirayama
2015/0078933 A1 3/2015 Takashima et al.

FOREIGN PATENT DOCUMENTS

JP 2004-293332 A 10/2004
WO 2011/125652 A1 10/2011
WO 2014025025 A1 2/2014

OTHER PUBLICATIONS

Extended European Search Report issued in corresponding European Patent Application No. 17166030.1, dated Sep. 4, 2017.

*Primary Examiner* — Mary Davis
(74) *Attorney, Agent, or Firm* — McDermott Will & Emery LLP

(57) ABSTRACT

In an outer circumferential portion of an intermediate partition plate, a concave portion is provided at a position at which an upper vane and a lower vane slide. At a lower dead center of an upper piston and a lower piston, 80% or more of the entire length in the sliding direction of the upper vane and the lower vane are accommodated respectively on the inside of an upper cylinder and the inside of a lower cylinder. In the concave portion, a width W with respect the circumferential direction of the intermediate partition plate is greater than a thickness T of the upper vane and the lower vane, and when a depth of the concave portion is D and the entire length of the upper vane and the lower vane is L, $D \geq 0.1 \times L$ is satisfied.

3 Claims, 6 Drawing Sheets

ROTARY COMPRESSOR

CROSS-REFERENCE TO RELATED APPLICATION

This application is based upon and claims the benefit of priorities from Japanese Patent Application No. 2016-080229 filed on Apr. 13, 2016, the entire contents of which are incorporated herein by reference.

FIELD

The present invention relates to a rotary compressor.

BACKGROUND

In a rotary compressor, an annular piston provided to be eccentric to a rotation shaft rotates in a cylinder, a tip end of a plate-like vane which reciprocates in the cylinder in accordance with rotation of the piston is thrust to an outer circumferential surface of the piston, and accordingly, the inside of the cylinder is divided into a compression chamber and an inlet chamber. In a two-cylinder type rotary compressor, the vane slides in a vane groove of the cylinder nipped by an end plate and an intermediate partition plate in a state of being biased by a spring.

In this type of rotary compressor, when a gas refrigerant is compressed by the piston in the cylinder, the rotation shaft is bent only by an extremely small amount with respect to the shaft direction. The piston is inclined with respect to the direction orthogonal to the rotation shaft in accordance with the bending of the rotation shaft, and the vane is inclined with respect to the sliding direction only by an amount of clearance between the vane and the vane groove in the upward-and-downward direction (the shaft direction of the rotation shaft) of the rotary compressor. Therefore, contact state between the tip end of the vane and the outer circumferential surface of the piston changes, and the tip end of the vane which slides in a state where the vane is bound in the vane groove is placed in a partially contact state with the outer circumferential surface of the piston. At this time, since a surface pressure of the tip end of the vane locally increases in the rotation shaft direction, there is a concern that wear or damage is generated in the vane or the piston.

As the rotary compressor of the related technology, in order to suppress the partially contact state of the vane with the piston, a configuration in which the vane is divided into two with respect to the rotation shaft direction, and the tip ends of the two vanes which are aligned in the rotation shaft direction respectively come into contact with the outer circumferential surface of the piston, is known. In this configuration, inclination is dispersed into the two vanes, and the partially contact state of the vane with the piston is suppressed.

WO 2014/025025 is an example of the related art.

However, in the rotary compressor of the above-described related art, by dividing the vane into two, sliding resistance is generated between each of the vanes. Therefore, there is an influence on sliding properties in the entire vane, and operation reliability of the entire vane deteriorates. In addition, since the springs are disposed in each vane divided into two, the structure becomes complicated, and manufacturing costs increase.

SUMMARY

Considering the above-described situation, an object of the invention is to provide a rotary compressor which can suppress a partially contact state of the vane with the piston, and improve operation reliability of the vane.

According to an aspect of the invention, there is provided a rotary compressor including: a sealed vertically-placed cylindrical compressor housing in which a discharging unit for a refrigerant is provided in an upper portion, and an inlet unit for the refrigerant is provided in a lower portion; a compressing unit which is disposed in the lower portion of the inside of the compressor housing, and which compresses the refrigerant suctioned from the inlet unit, and which discharges the refrigerant from the discharging unit; and a motor which is disposed in the upper portion of the inside of the compressor housing, and which drives the compressing unit, in which the compressing unit includes annular upper and lower cylinders, an upper end plate which closes an upper side of the upper cylinder, a lower end plate which closes a lower side of the lower cylinder, an intermediate partition plate which is disposed between the upper cylinder and the lower cylinder, and which closes the lower side of the upper cylinder and the upper side of the lower cylinder, a rotation shaft which is supported by a main bearing unit provided in the upper end plate and a sub-bearing unit provided in the lower end plate, and which is rotated by the motor, an upper eccentric portion and a lower eccentric portion which are provided in the rotation shaft by applying a phase difference of 180° therebetween, an upper piston which is fitted to the upper eccentric portion, and which revolves along an inner circumferential surface of the upper cylinder, and which forms an upper cylinder chamber on the inside of the upper cylinder, a lower piston which is fitted to the lower eccentric portion, and which revolves along an inner circumferential surface of the lower cylinder, and which forms a lower cylinder chamber on the inside of the lower cylinder, an upper vane which protrudes to the inside of the upper cylinder chamber from an upper vane groove provided in the upper cylinder, and which divides the upper cylinder chamber into an upper inlet chamber and an upper compression chamber by abutting against the upper piston, and a lower vane which protrudes to the inside of the lower cylinder chamber from a lower vane groove provided in the lower cylinder, and which divides the lower cylinder chamber into a lower inlet chamber and a lower compression chamber by abutting against the lower piston, in which a concave portion is provided at a position at which the upper vane and the lower vane slide in the outer circumferential portion of the intermediate partition plate, in which 80% or more of the entire length in the sliding direction of the lower vane and the upper vane are accommodated respectively on the inside of the upper cylinder and the inside of the lower cylinder at a lower dead center of the upper piston and the lower piston, in which, in the concave portion, a width W with respect to the circumferential direction of the intermediate partition plate is greater than a thickness T of the upper vane and the lower vane, and in which $D \geq 0.1 \times L$ is satisfied when a depth of the concave portion is D and the entire length of the upper vane and the lower vane is L.

In the rotary compressor according to one aspect of the invention, it is possible to suppress a partially contact state of a vane with a piston, and to improve operation reliability of the vane.

DESCRIPTION OF EMBODIMENTS

Hereinafter, an embodiment of a rotary compressor of the invention will be described in detail based on the drawings. In addition, the rotary compressor of the invention is not limited to the following embodiment.

Embodiment

Configuration of Rotary Compressor

Figure 1:
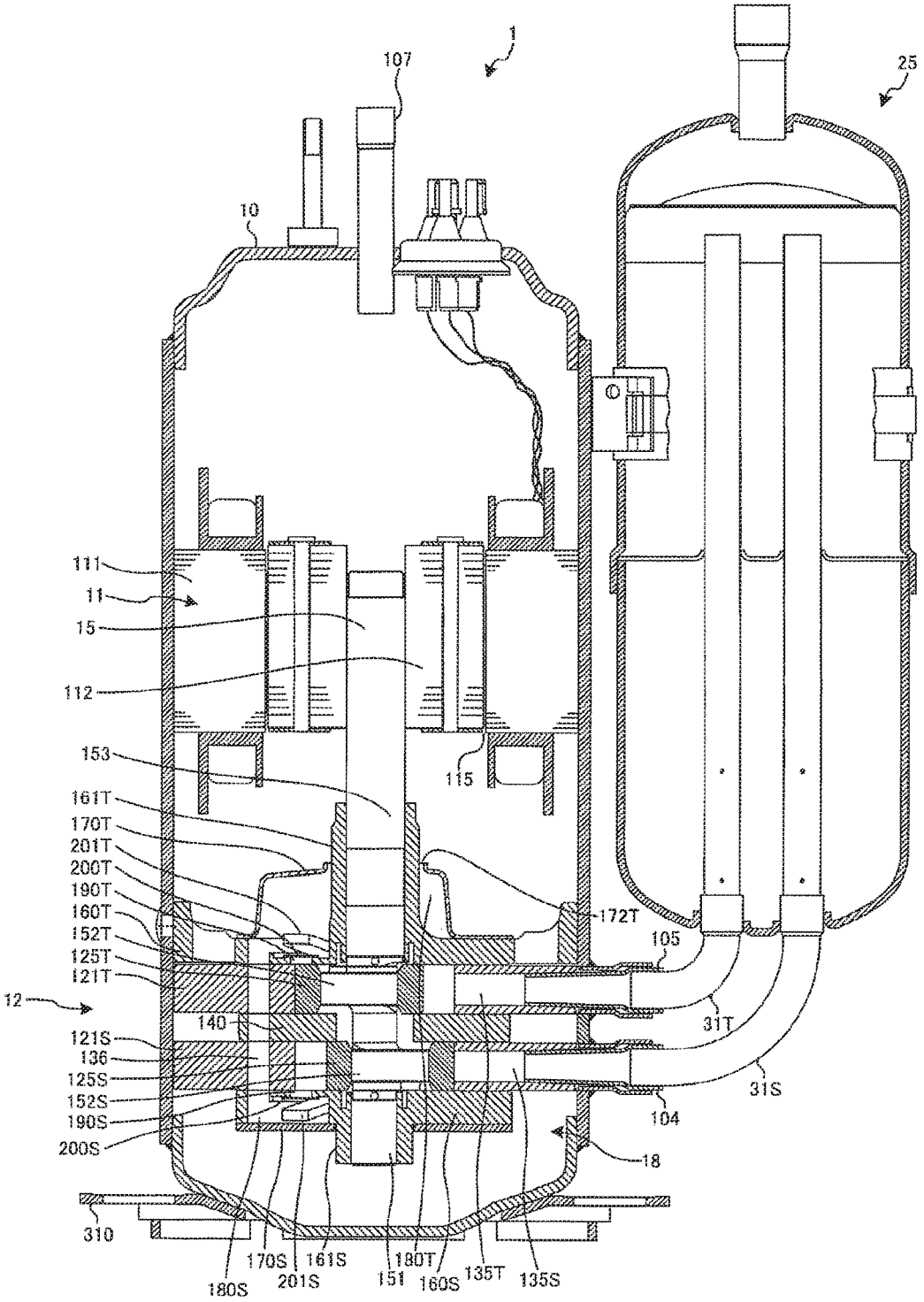
FIG. 1 is a longitudinal sectional view illustrating a rotary compressor according to an embodiment.
Figure 2:
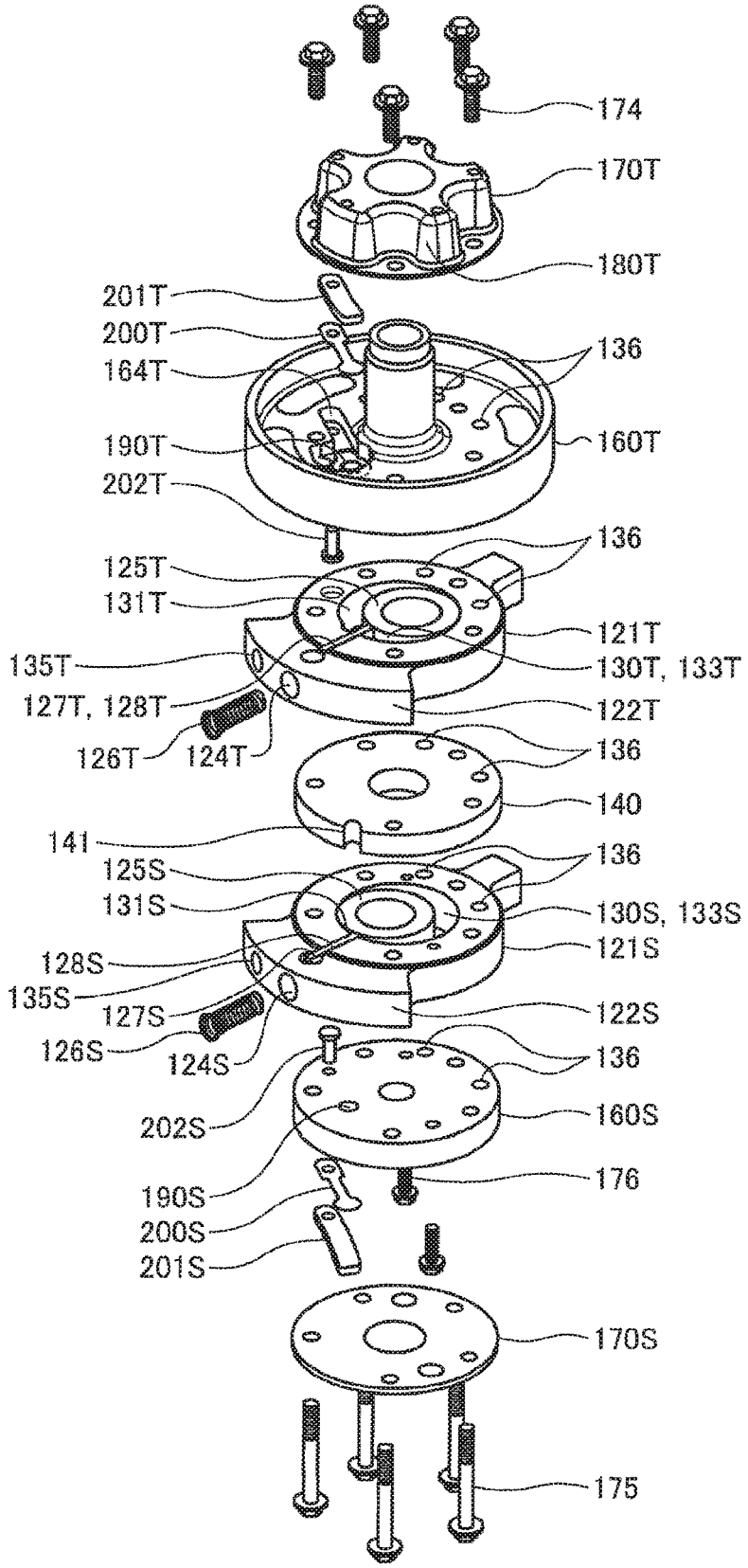
FIG. 2 is an exploded perspective view illustrating a compressing unit of the rotary compressor according to the embodiment.
Figure 3:
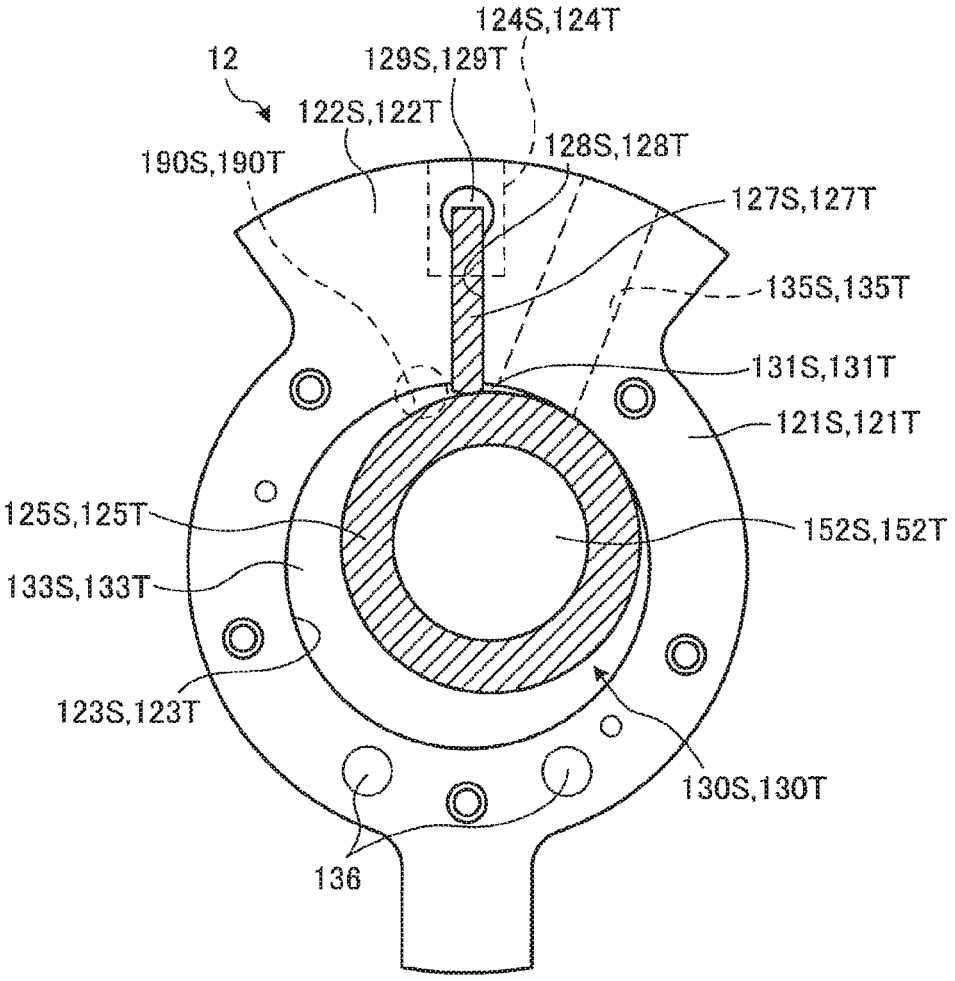
FIG. 3 is a lateral sectional view when the compressing unit of the rotary compressor according to the embodiment is viewed from above.

FIG. 1 is a longitudinal sectional view illustrating a rotary compressor according to an embodiment. FIG. 2 is an exploded perspective view illustrating a compressing unit of the rotary compressor according to the embodiment. FIG. 3 is a lateral sectional view when the compressing unit of the rotary compressor according to the embodiment is viewed from above.

As illustrated in FIG. 1, a rotary compressor 1 includes: a compressing unit 12 which is disposed in a lower portion of the inside of a sealed vertically-placed cylindrical compressor housing 10; a motor 11 which is disposed on an upper portion of the inside of the compressor housing 10, and drives the compressing unit 12 via a rotation shaft 15; and a vertically-placed cylindrical accumulator 25 which is fixed to an outer circumferential surface of the compressor housing 10.

The accumulator 25 is connected to an upper cylinder chamber 130T (refer to FIG. 2) of an upper cylinder 121T via an inlet unit configured of an upper inlet pipe 105 and an accumulator upper L-pipe 31T, and is connected to a lower cylinder chamber 130S (refer to FIG. 2) of a lower cylinder 121S via an inlet unit configured of a lower inlet pipe 104 and an accumulator lower L-pipe 31S.

The motor 11 includes a stator 111 which is disposed on an outer side, and a rotor 112 which is disposed on an inner side. The stator 111 is fixed to an inner circumferential surface of the compressor housing 10 in a shrink fit state, and the rotor 112 is fixed to the rotation shaft 15 in a shrink fit state.

In the rotation shaft 15, a sub-shaft unit 151 on a lower side of a lower eccentric portion 152S is supported to be freely rotated by a sub-bearing unit 161S provided in a lower end plate 160S, and a main shaft unit 153 on an upper side of an upper eccentric portion 152T is supported to be freely rotated by a main bearing unit 161T provided in an upper end plate 160T. The rotation shaft 15 is supported to be freely rotated with respect to the compressing unit 12 as each of an upper piston 125T and a lower piston 125S is supported by the upper eccentric portion 152T and the lower eccentric portion 152S which are provided by applying a phase difference of 180 degrees therebetween. In addition, by the rotation of the rotation shaft 15, the upper piston 125T and the lower piston 125S are operated to revolve along the inner circumferential surfaces of each of the upper cylinder 121T and the lower cylinder 121S.

In order to ensure sliding properties of a sliding portion, such as the upper piston 125T and the lower piston 125S, which slide in the compressing unit 12, and to seal an upper compression chamber 133T (refer to FIG. 2) and a lower compression chamber 133S (refer to FIG. 2), lubricant oil 18 having an amount by which the compressing unit 12 is substantially immersed is sealed on the inside of the compressor housing 10. An attachment leg 310 (refer to FIG. 1) which locks a plurality of elastic supporting members (not illustrated) that support the entire rotary compressor 1 is fixed to a lower side of the compressor housing 10.

As illustrated in FIG. 1, the compressing unit 12 compresses a refrigerant suctioned from the upper inlet pipe 105 and the lower inlet pipe 104, and discharges the refrigerant from a discharge pipe 107 which will be described later. As described in FIG. 2, the compressing unit 12 is configured by stacking an upper end plate cover 170T including a bulging portion in which a hollow space is formed in an inner portion, the upper end plate 160T, the annular upper cylinder 121T, an intermediate partition plate 140, the annular lower cylinder 121S, the lower end plate 160S, and a flat plate-like lower end plate cover 170S, in order from above. The entire compressing unit 12 is fixed by a plurality of penetrating bolts 174 and 175 and an auxiliary bolt 176 which are disposed on a substantially concentric circle from above and below.

As illustrated in FIG. 3, in the upper cylinder 121T, an upper cylinder inner wall 123T is formed along the circle concentric to the rotation shaft 15 of the motor 11. On the inside of the upper cylinder inner wall 123T, the upper piston 125T which has an outer diameter smaller than an inner diameter of the upper cylinder 121T is disposed, and between the upper cylinder inner wall 123T and the upper piston 125T, the upper compression chamber 133T which suctions, compresses, and discharges the refrigerant is formed. In the lower cylinder 121S, along the circle concentric to the rotation shaft 15 of the motor 11, a lower cylinder inner wall 123S is formed. On the lower cylinder inner wall 123S, the lower piston 125S which has an outer diameter smaller than an inner diameter of the lower cylinder 121S is disposed, and between the lower cylinder inner wall 123S and the lower piston 125S, the lower compression chamber 133S which suctions, compresses, and discharges the refrigerant is formed.

As illustrated in FIGS. 2 and 3, the upper cylinder 121T has an upper side protruding portion 122T which overhung from a round outer circumference. In the upper side protruding portion 122T, an upper vane groove 128T which extends from the upper cylinder chamber 130T to the outside in a radial shape, is provided. On the inside of the upper vane groove 128T, an upper vane 127T is disposed to be slidable. The lower cylinder 121S has a lower side protruding portion 122S which is overhung from the round outer circumference. In the lower side protruding portion 122S, a lower vane groove 128S which extends from the lower cylinder chamber 130S to the outside in a radial shape, is provided. On the inside of the lower vane groove 128S, a lower vane 127S is disposed to be slidable.

At a position which overlaps the upper vane groove 128T from the outside surface of the upper cylinder 121T, an upper spring hole 124T is provided at a depth which does not reach the upper cylinder chamber 130T. An upper spring 126T is disposed in the upper spring hole 124T. At a position which overlaps the lower vane groove 128S from the outside surface of the lower cylinder 121S, a lower spring hole 124S is provided at a depth which does not reach the lower cylinder chamber 130S. A lower spring 126S is disposed in the lower spring hole 124S.

In addition, in the lower cylinder 121S, a lower pressure guiding-in path 129S which communicates with the outer side in the radial direction of the lower vane groove 128S and the inside of the compressor housing 10, has an opening portion that introduces the compressed refrigerant on the inside of the compressor housing 10, and applies a back pressure to the lower vane 127S by a pressure of the refrigerant, is formed. In addition, the refrigerant compressed on the inside of the compressor housing 10 is also introduced from the lower spring hole 124S. In addition, in the upper cylinder 121T, an upper pressure guiding-in path 129T which communicates with the outer side in the radial direction of the upper vane groove 128T and the inside of the compressor housing 10, has an opening portion that introduces the compressed refrigerant on the inside of the compressor housing 10, and applies a back pressure to the upper vane 127T by a pressure of the refrigerant, is formed. In addition, the refrigerant compressed on the inside of the compressor housing 10 is also introduced from the upper spring hole 124T.

As illustrated in FIG. 3, in the upper side protruding portion 122T of the upper cylinder 121T, an upper inlet hole 135T which is fitted to the upper inlet pipe 105 is provided. In the lower side protruding portion 122S of the lower cylinder 121S, a lower inlet hole 135S which is fitted to the lower inlet pipe 104 is provided.

As illustrated in FIG. 2, upper and lower parts of the upper cylinder chamber 130T are closed by each of the upper end plate 160T and the intermediate partition plate 140. Upper and lower parts of the lower cylinder chamber 130S is closed by each of the intermediate partition plate 140 and the lower end plate 160S.

As illustrated in FIG. 3, as the upper vane 127T is pressed to the upper spring 126T, and abuts against the outer circumferential surface of the upper piston 125T, the upper cylinder chamber 130T is divided into an upper inlet chamber 131T which communicates with the upper inlet hole 135T, and the upper compression chamber 133T which communicates with an upper discharge hole 190T provided in the upper end plate 160T. As the lower vane 127S is pressed to the lower spring 126S, and abuts against the outer circumferential surface of the lower piston 125S, the lower cylinder chamber 130S is divided into a lower inlet chamber 131S which communicates with the lower inlet hole 135S, and the lower compression chamber 133S which communicates with a lower discharge hole 190S provided in the lower end plate 160S.

As illustrated in FIG. 2, in the upper end plate 160T, the upper discharge hole 190T which penetrates the upper end plate 160T and communicates with the upper compression chamber 133T of the upper cylinder 121T, is provided, and an upper valve seat (not illustrated) is formed around the upper discharge hole 190T on an outlet side of the upper discharge hole 190T. In the upper end plate 160T, an upper discharge valve accommodation concave portion 164T which extends from a position of the upper discharge hole 190T in a shape of a groove in the circumferential direction of the upper end plate 160T, is formed.

In the upper discharge valve accommodation concave portion 164T, all of a reed valve type upper discharge valve 200T which includes a rear end portion fixed to the inside of the upper discharge valve accommodation concave portion 164T by an upper rivet 202T, and a front portion which opens and closes the upper discharge hole 190T; and an upper discharge valve cap 201T which overlaps the upper discharge valve 200T, and includes a rear end portion fixed to the inside of the upper discharge valve accommodation concave portion 164T by the upper rivet 202T, and a curved (distorted) front portion which controls an opening degree of the upper discharge valve 200T, are accommodated.

In the lower end plate 160S, the lower discharge hole 190S which penetrates the lower end plate 160S and communicates with the lower compression chamber 133S of the lower cylinder 121S, is provided. In the lower end plate 160S, a lower discharge valve accommodation concave portion (not illustrated) which extends from the position of the lower discharge hole 190S in a shape of a groove in the circumferential direction of the lower end plate 160S, is formed.

In the lower discharge valve accommodation concave portion, all of a reed valve type lower discharge valve 200S which includes a rear end portion fixed to the inside of the lower discharge valve accommodation concave portion by a lower rivet 202S, and a front portion which opens and closes the lower discharge hole 190S; and a lower discharge valve cap 201S which overlaps the lower discharge valve 200S, and includes a rear end portion fixed to the inside of the lower discharge valve accommodation concave portion by the lower rivet 202S, and a curved (distorted) front portion which controls an opening degree of the lower discharge valve 200S, are accommodated.

Between the upper end plate 160T and the upper end plate cover 170T having a bulging portion which are fixed to adhere to each other, an upper end plate cover chamber 180T is formed. Between the lower end plate 160S and the flat plate-like lower end plate cover 170S which are fixed to adhere to each other, a lower end plate cover chamber 180S (refer to FIG. 1) is formed. A refrigerant path hole 136 which penetrates the lower end plate 160S, the lower cylinder 121S, the intermediate partition plate 140, the upper end plate 160T, and the upper cylinder 121T, and communicates with the lower end plate cover chamber 180S and the upper end plate cover chamber 180T, is provided.

Hereinafter, a flow of the refrigerant due to the rotation of the rotation shaft 15 will be described. On the inside of the upper cylinder chamber 130T, the upper piston 125T which is fitted to the upper eccentric portion 152T of the rotation shaft 15 revolves along the outer circumferential surface (the inner circumferential surface of the upper cylinder 121T) of the upper cylinder chamber 130T due to the rotation of the rotation shaft 15. Accordingly, the upper inlet chamber 131T suctions the refrigerant from the upper inlet pipe 105 while enlarging capacity, and the upper compression chamber 133T compresses the refrigerant while reducing the capacity. When the pressure of the compressed refrigerant becomes higher than the pressure of the upper end plate cover chamber 180T on the outer side of the upper discharge valve 200T, the upper discharge valve 200T is open, and the refrigerant is discharged to the upper end plate cover chamber 180T from the upper compression chamber 133T. The refrigerant discharged to the upper end plate cover chamber 180T is discharged to the inside of the compressor housing 10 from an upper end plate cover discharge hole 172T (refer to FIG. 1) provided in the upper end plate cover 170T.

In addition, in the lower cylinder chamber 130S, the lower piston 125S fitted to the lower eccentric portion 152S of the rotation shaft 15 revolves along the outer circumferential surface (the inner circumferential surface of the lower cylinder 121S) of the lower cylinder chamber 130S due to the rotation of the rotation shaft 15. Accordingly, the lower inlet chamber 131S suctions the refrigerant from the lower inlet pipe 104 while enlarging the capacity, and the lower compression chamber 133S compresses the refrigerant while reducing the capacity. When the pressure of the compressed refrigerant becomes higher than the pressure of the lower end plate cover chamber 180S on the outer side of the lower discharge valve 200S, the lower discharge valve 200S is open, and the refrigerant is discharged to the lower end plate cover chamber 180S from the lower compression chamber 133S. The refrigerant discharged to the lower end plate cover chamber 180S is discharged to the inside of the compressor housing 10 from the upper end plate cover discharge hole 172T provided in the upper end plate cover 170T through the refrigerant path hole 136 and the upper end plate cover chamber 180T.

The refrigerant discharged to the inside of the compressor housing 10 is guided to the upper part of the motor 11 through a cutout (not illustrated) which is provided on the outer circumference of the stator 111, and communicates with the upper and lower parts, a void (not illustrated) of a winding portion of the stator 111, or a void 115 (refer to FIG. 1) between the stator 111 and the rotor 112, and is discharged from the discharge pipe 107 which serves as a discharging unit disposed in the upper portion of the compressor housing 10.

Characteristic Configuration of Rotary Compressor

Figure 4:
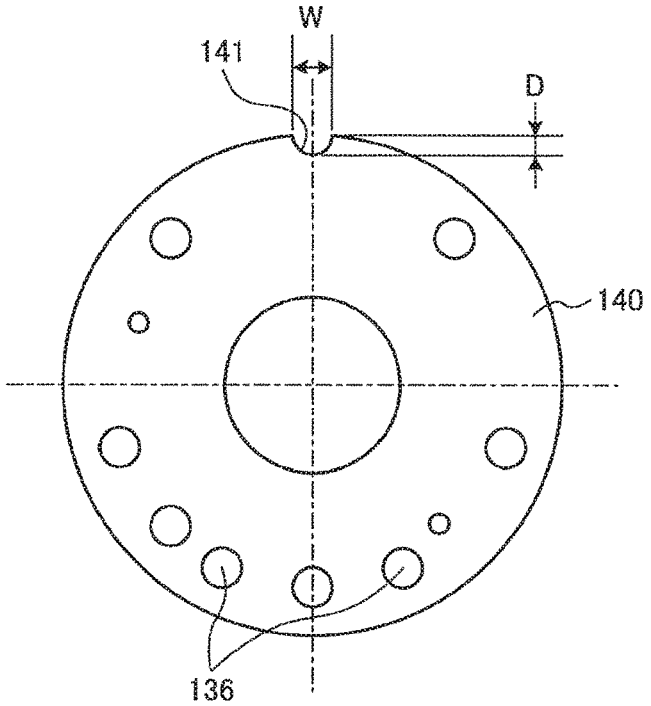
FIG. 4 is a plan view illustrating an intermediate partition plate of the rotary compressor according to the embodiment.
Figure 5:
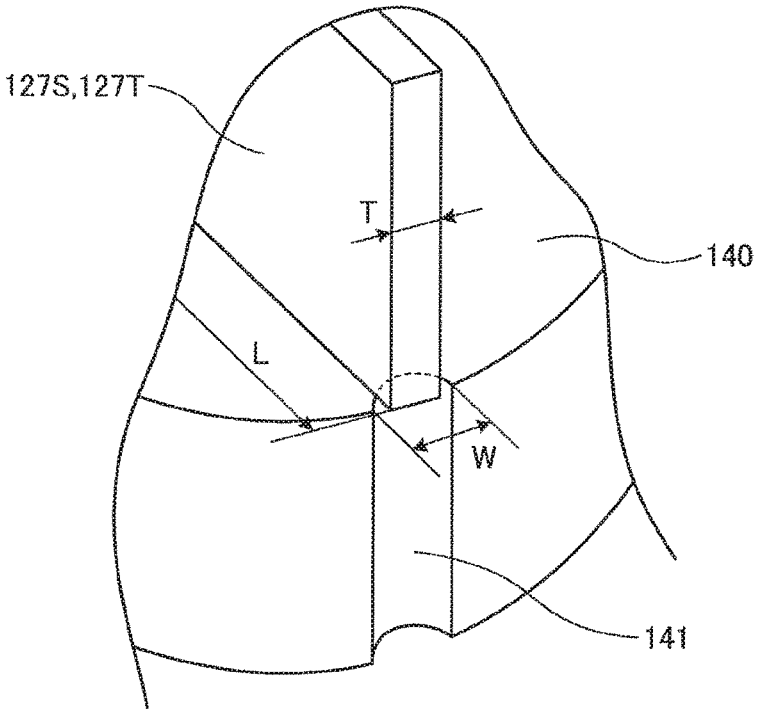
FIG. 5 is a partially perspective view illustrating a concave portion of the intermediate partition plate of the rotary compressor according to the embodiment.

Next, a characteristic configuration of the rotary compressor 1 according to the embodiment will be described. FIG. 4 is a plan view illustrating the intermediate partition plate 140 of the rotary compressor 1 according to the embodiment. FIG. 5 is a partially perspective view illustrating a concave portion of the intermediate partition plate 140 of the rotary compressor 1 according to the embodiment.

As illustrated in FIGS. 4 and 5, in the outer circumferential portion, of the intermediate partition plate 140, a sectional arc-like concave portion 141 is provided at a position at which the upper vane 127T and the lower vane 127S slide. In other words, the concave portion 141 is formed at a position which respectively opposes the end portion on the outer circumference side of the intermediate partition plate 140 in the upper vane groove 128T and the lower vane groove 128S. In addition, the concave portion 141 is formed from one surface side to the other surface side in the direction of the rotation shaft 15 in the intermediate partition plate 140.

As illustrated in FIG. 5, in the concave portion 141, a width W with respect to the circumferential direction of he intermediate partition plate 140 is greater than a thickness T of the upper vane 127T and the lower vane 127S. Accordingly, as will be described later, the upper vane 127T and the lower vane 127S can enter the inside of the concave portion 141, and it becomes possible to correct inclination with respect to the sliding direction of the upper vane 127T and the lower vane 127S.

In the embodiment, at a lower dead center of the upper piston 125T and the lower piston 125S, 80% or more of the entire length L in the sliding direction (the reciprocating direction with respect to the upper cylinder 121T and the lower cylinder 121S) of the upper vane 127T and the lower vane 127S are accommodated respectively on the inside of the upper cylinder 121T and the inside of the lower cylinder 121S.

In the concave portion 141, a depth D with respect to the radial direction of the intermediate partition plate 140 is equal to or greater than 10% of the entire length L of the upper vane 127T and the lower vane 127S. In other words, when the depth of the concave portion 141 is D and the entire length of the upper vane 127T and the lower vane 127S is L, $D \geq 0.1 \times L$ Expression 1) is satisfied.

Action of Concave Portion of Intermediate Partition Plate

Figure 6A:
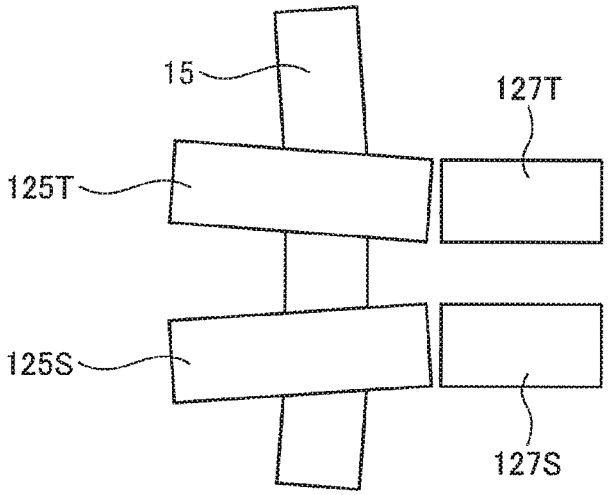
FIG. 6A is a schematic view illustrating a state where an upper piston and a lower piston are inclined in accordance with bending of a rotation shaft in the rotary compressor according to the embodiment.
Figure 6B:
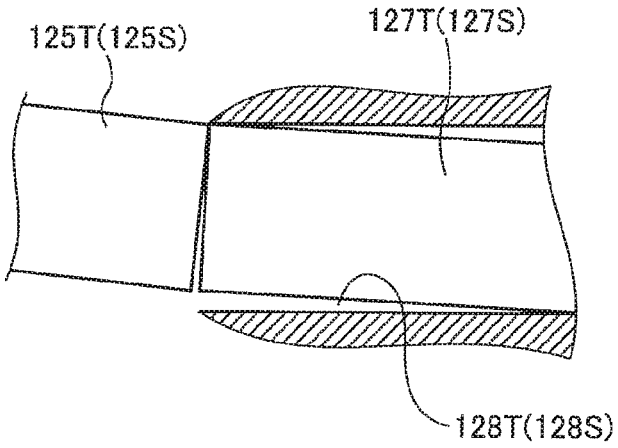
FIG. 6B is a schematic view illustrating a state where an upper vane is inclined in an upper vane groove in the rotary compressor according to the embodiment.

In the rotary compressor 1, when the refrigerant is compressed by the upper piston 125T and the lower piston 125S on the inside of the upper cylinder 121T and on the inside of the lower cylinder 121S, the rotation shaft 15 is bent only by an extremely small amount with respect to the shaft direction. As illustrated in FIG. 6A, the upper piston 125T and the lower piston 125S are inclined with respect to the direction orthogonal to the rotation shaft 15 in accordance with the bending of the rotation shaft 15. In accordance with the inclination of the upper piston 125T and the lower piston 125S, the upper vane 127T and the lower vane 127S are inclined with respect to the sliding direction only by an amount of clearance between the upper vane 127T and the upper vane groove 121T, and only by an amount of clearance between the lower vane 127S and the lower vane groove 128S in the upward-and-downward direction (the shaft direction of the rotation shaft 15) of the rotary compressor 1, as illustrated in FIG. 6B. Therefore, a contact state between a tip end of the upper vane 127T and an outer circumferential surface of the upper piston 125T, and a contact state between a tip end of the lower vane 127S and an outer circumferential surface of the lower piston 125S change, there is a concern that the tip ends of the upper vane 127T and the lower vane 127S which slide in a state of being bound on the inside of the upper vane groove 128T and the lower vane groove 128S, are placed in a partially contact with the outer circumferential surface of the upper piston 125T and the lower piston 125S.

Figure 6C:
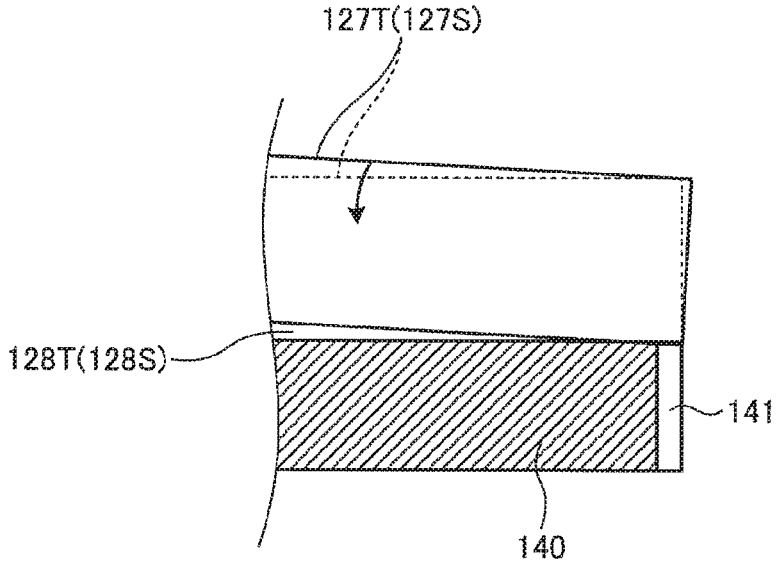
FIG. 6C is a schematic view illustrating a state where inclination of the upper vane is corrected by the concave portion of the intermediate partition plate in the rotary compressor according to the embodiment.

However, in the embodiment, as illustrated in FIG. 6B, even in a case where the inclination is generated in the upper piston 125T and the lower piston 125S, and the upper vane 127T and the lower vane 127S in accordance with the bending of the rotation shaft 15, as illustrated in FIG. 6C, as the end portion of the upper vane 127T and the lower vane 127S enters the inside of the concave portion 141 in an inclined state, the concave portion 141 acts as a clearance (allowance) of the upper vane 127T and the lower vane 127S. Therefore, a binding force is reduced in the height direction. (the direction of the rotation shaft 15) of the upper vane 127T and the lower vane 127S that slide while being bound on the inside of the upper vane groove 128T and the inside of the lower vane groove 128S, and postures of the upper vane 127T and the lower vane 127S are likely to change on the inside of the upper vane groove 128T and the inside of the lower vane groove 128S. Accordingly, in the upper vane 127T (lower vane 127S), an inclined state (solid line in FIG. 6C) when a jumping amount to the upper cylinder chamber 130T (lower cylinder chamber 130S) is small, can be smoothly corrected to era appropriate state (broken line in FIG. 6C) when the jumping amount to the upper cylinder chamber 130T (lower cylinder chamber 130S) is large, and the upper vane 127T (lower vane 127S) can return to an appropriate sliding state. In the concave portion 141 of the intermediate partition plate 140, as the depth D satisfies the above-described expression 1, an inclination correction action of the upper vane 127T and the lower vane 127S with respect to the height direction can be appropriately obtained. In addition, FIGS. 6B and 6C illustrate the inclined state of the upper vane 127T on the inside of the upper vane groove 128T in accordance with the inclination of the upper piston 125T, but the inclined state of the lower vane 127S on the inside of the lower vane groove 128S in accordance with the inclination of the lower piston 125S, is also similar.

A case where the depth D of the concave portion 141 is less than 10% of the entire length L of the upper vane 127T and the lower vane 127S, is not preferable since the depth is not sufficient, and the action of correcting the inclined state of the upper vane 127T and the lower vane 127S is not sufficiently performed.

In addition, when cutting processing is performed with respect to the intermediate partition plate 140 in the thickness direction, the concave portion 141 is used as a positioning concave portion for fitting a positioning pin that positions the intermediate partition plate 140 with respect to a processing jig. Therefore, in the embodiment, by using the positioning concave portion as the concave portion 141 for correcting the inclination of the upper vane 127T and the lower vane 127S, it is not necessary to perform additional processing with respect to the concave portion 141 in the outer circumferential portion of the intermediate partition plate 140, and an increase in manufacturing costs of the rotary compressor 1 is suppressed.

In addition, when casting the intermediate partition plate 140, the concave portion 141 is formed as a part of an outer shape of the intermediate partition plate 140. Therefore, in the concave portion 141, a cut taper for removing the intermediate partition plate 140 from the inside of a molding die when casting the intermediate partition plate 140, is provided. Specifically, the concave portion. 141 is formed in a tapered shape in which the depth D with respect to the radial direction of the intermediate partition plate 140 gradually decreases from the one surface side to the other surface side in the direction of the rotation shaft 15 in the intermediate partition plate 140. Accordingly, it becomes possible to take out the intermediate partition plate 140 from the inside of the molding die during the casting. In the embodiment, since the concave portion 141 is used as the concave portion 141 for correcting the inclination of the upper vane 127T and the lower vane 127S, the taper is provided. Therefore, even in a case of the depth D of the concave portion 141 at the other end of the intermediate partition plate 140, the above-described expression 1 is satisfied.

Effect of Embodiment.

As described above, in the outer circumferential portion of the intermediate partition plate 140 in the rotary compressor 1 according to the embodiment, the concave portion 141 is provided at a position at which the upper vane 127T and the lower vane 127S slide, and at the lower dead center of the upper piston 125T and the lower piston 125S, 80% or more of the entire length in the sliding direction of the upper vane 127T and the lower vane 127S are accommodated respectively on the inside of the upper cylinder 121T and the inside of the lower cylinder 121S. In addition, when the depth of the concave portion 141 is D and the entire length of this upper vane 127T and the lower vane 127S is L, $D \geq 0.1 \times L$ (Expression 1) is satisfied. Accordingly, generation of a partially contact state of the upper vane 127T and the upper piston 125T, and a partially contact state of the lower vane 127S and the lower piston 125S, can be suppressed, and wear or damage of the upper vane 127T, the lower vane 127S, the upper piston 125T, and the lower piston 125S, can be suppressed. Therefore, operation reliability of the upper vane 127T and the lower vane 127S can be improved.

In addition, in the rotary compressor 1 according to the embodiment, by using the positioning concave portion for processing the intermediate partition plate 140 as the concave portion 141 for correcting the inclination of the upper vane 127T and the lower vane 127S, it is not necessary to perform additional processing with respect to the concave portion 141 in the outer circumferential portion of the intermediate partition plate 140. Therefore, it is possible to suppress an increase in manufacturing costs of the rotary compressor 1.

Above, the embodiments are described, but the embodiments are not limited to the above-described contents. In addition, in the above-described configuration elements, configuration elements which can be easily considered by those skilled in the art, and which are in substantially the same range, that is, a so-called equivalent range, are included. Furthermore, it is possible to appropriately combine the above-described configuration elements. Furthermore, at least any one of various omissions, replacements, and changes of the configuration elements can be performed within a range which does not depart from the scope of the embodiments.

What is claimed is:

1. A rotary compressor comprising:

a sealed vertically-placed cylindrical compressor housing in which a discharging unit for a refrigerant is provided in an upper portion, and an inlet unit for the refrigerant is provided in a lower portion;

a compressing unit which is disposed in the lower portion of the inside of the compressor housing, and which compresses the refrigerant suctioned from the inlet unit, and which discharges the refrigerant from the discharging unit; and a motor which is disposed in the upper portion of the inside of the compressor housing, and drives the compressing unit, wherein the compressing unit includes annular upper and lower cylinders, an upper end plate which closes an upper side of the upper cylinder, a lower end plate which closes a lower side of the lower cylinder, an intermediate partition plate which is disposed between the upper cylinder and the lower cylinder, and which closes the lower side of the upper cylinder and the upper side of the lower cylinder, a rotation shaft which is rotated by the motor, an upper eccentric portion and a lower eccentric portion which are provided in the rotation shaft by applying a phase difference of 180° therebetween, an upper piston which is fitted to the upper eccentric portion, and which revolves along an inner circumferential surface of the upper cylinder, and which forms an upper cylinder chamber on the inside of the upper cylinder, a lower piston which is fitted to the lower eccentric portion, and which revolves along an inner circumferential surface of the lower cylinder, and which forms a lower cylinder chamber on the inside of the lower cylinder, an upper vane which protrudes to the inside of the upper cylinder chamber from an upper vane groove provided in the upper cylinder, and which divides the upper cylinder chamber into an upper inlet chamber and an upper compression chamber by abutting against the upper piston, and a lower vane which protrudes to the inside of the lower cylinder chamber from a lower vane groove provided in the lower cylinder, and which divides the lower cylinder chamber into a lower inlet chamber and a lower compression chamber by abutting against the lower piston, wherein a concave portion is provided at a position at which the upper vane and the lower vane slide in the outer circumferential portion of the intermediate partition plate, wherein 80% or more of the entire length in the sliding direction of the upper vane and the lower vane are accommodated respectively on the inside of the upper cylinder and the inside of the lower cylinder at a lower dead center of the upper piston and the lower piston, wherein, in the concave portion, a width W with respect to the circumferential direction of the intermediate partition plate is greater than a thickness T of the upper vane and the lower vane, and wherein $D \geq 0.1 \times L$ is satisfied when a depth of the concave portion is D and the entire length of the upper vane and the lower vane is L.

2. The rotary compressor according to claim 1, wherein the concave portion is formed from one surface side to the other surface side in the rotation shaft direction in the intermediate partition plate.

3. The rotary compressor according to claim. 2, wherein the concave portion is formed in a tapered shape in which the depth D gradually decreases from the one surface side toward the other surface side of the intermediate partition plate.

* * * * *